US011026555B2

(12) United States Patent
Minde et al.

(10) Patent No.: US 11,026,555 B2
(45) Date of Patent: Jun. 8, 2021

(54) DISHWASHER COMPRISING A WASH ARM ARRANGEMENT

(71) Applicant: ELECTROLUX APPLIANCES AKTIEBOLAG, Stockholm (SE)

(72) Inventors: Marie Minde, Stockholm (SE); Anders Haegermarck, Trångsund (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 304 days.

(21) Appl. No.: 15/778,784

(22) PCT Filed: Dec. 21, 2015

(86) PCT No.: PCT/EP2015/080746
§ 371 (c)(1),
(2) Date: May 24, 2018

(87) PCT Pub. No.: WO2017/108072
PCT Pub. Date: Jun. 29, 2017

(65) Prior Publication Data

US 2018/0344126 A1 Dec. 6, 2018

(51) Int. Cl.
*A47L 15/22* (2006.01)
*A47L 15/44* (2006.01)
(Continued)

(52) U.S. Cl.
CPC ..... *A47L 15/22* (2013.01); *A47L 15/23* (2013.01); *A47L 15/4278* (2013.01); *A47L 15/44* (2013.01); *A47L 15/4409* (2013.01)

(58) Field of Classification Search
CPC ..... A47L 15/4278; A47L 15/23; A47L 15/44; A47L 15/22; A47L 15/4409
See application file for complete search history.

(56) References Cited

U.S. PATENT DOCUMENTS 1,408,077 A 2/1922 Clinton
3,342,421 A 9/1967 Schutte
(Continued)

FOREIGN PATENT DOCUMENTS

CH 564937 A5 8/1975
CN 102170816 8/2011
(Continued)

OTHER PUBLICATIONS

International Search Report and Written Opinion for Application No. PCT/EP2015/080746 dated Sep. 2, 2016, 11 pages.
(Continued)

*Primary Examiner* — Benjamin L Osterhout
(74) *Attorney, Agent, or Firm* — Alston & Bird LLP

(57) ABSTRACT

A dishwasher may include a washing chamber, a door having a detergent dispenser, and a wash arm arrangement with a rotatable first wash arm and a second wash arm which may be rotatably attached to the rotatable first wash arm. The second wash arm may include a spray nozzle arranged to expel washing liquid in a direction relatively the second wash arm. The second wash arm may be arranged to bring the spray nozzle along a circular path with a radius in a plane during a rotation cycle of the second wash arm. The direction may have a first angle in the plane relatively the radius and a second angle relatively the plane, and the spray nozzle may be arranged to be directed in the direction towards the detergent dispenser during at least a portion of the rotation cycle to cause the washing liquid to intersect with the detergent dispenser.

12 Claims, 4 Drawing Sheets

(51) Int. Cl.
*A47L 15/42* (2006.01)
*A47L 15/23* (2006.01)

(56) References Cited

U.S. PATENT DOCUMENTS

| | | | | |
|---|---|---|---|---|
| 3,771,725 | A | 11/1973 | Jenkins et al. | |
| 4,064,887 | A | 12/1977 | Geiger et al. | |
| 4,210,285 | A | 7/1980 | Dicken, Jr. et al. | |
| 4,869,428 | A | 9/1989 | Gombar | |
| 5,268,153 | A * | 12/1993 | Muller | A47L 15/4436 222/318 |
| 5,477,874 | A | 12/1995 | Yura et al. | |
| 5,542,443 | A | 8/1996 | Yura et al. | |
| 5,598,976 | A | 2/1997 | Jang et al. | |
| D461,284 | S | 8/2002 | Hegeman et al. | |
| 6,959,881 | B2 | 11/2005 | Kim | |
| 7,237,563 | B2 | 7/2007 | Han et al. | |
| 7,988,791 | B2 | 8/2011 | Delgado | |
| 8,020,568 | B2 | 9/2011 | Pyo et al. | |
| 8,211,243 | B2 | 7/2012 | Delgado | |
| 8,287,660 | B2 | 10/2012 | Angiband | |
| 8,333,207 | B2 | 12/2012 | Calhoun et al. | |
| D675,387 | S | 1/2013 | Burrows et al. | |
| 8,858,729 | B2 | 10/2014 | Buddharaju et al. | |
| 8,939,162 | B2 | 1/2015 | Winkler et al. | |
| 8,985,126 | B2 | 3/2015 | Forster et al. | |
| 9,010,345 | B2 | 4/2015 | Mitchell et al. | |
| 9,462,924 | B2 | 10/2016 | Pyo et al. | |
| 9,462,927 | B2 | 10/2016 | Lee et al. | |
| 2005/0045672 | A1 | 3/2005 | Marone | |
| 2005/0224098 | A1 * | 10/2005 | Fujii | A47L 15/44 134/26 |
| 2005/0230502 | A1 | 10/2005 | Bragg et al. | |
| 2009/0145468 | A1 | 6/2009 | Chericoni | |
| 2009/0255560 | A1 | 10/2009 | Lehmann et al. | |
| 2010/0012158 | A1 * | 1/2010 | Rosenbauer | A47L 15/4445 134/93 |
| 2010/0065091 | A1 * | 3/2010 | Hartmann | A47L 15/4445 134/104.2 |
| 2011/0174345 | A1 | 7/2011 | Carrer et al. | |
| 2011/0203619 | A1 | 8/2011 | Kara et al. | |
| 2012/0279536 | A1 | 11/2012 | Adams et al. | |
| 2012/0305037 | A1 | 12/2012 | Petric et al. | |
| 2013/0125936 | A1 | 5/2013 | Forster et al. | |
| 2013/0284216 | A1 | 10/2013 | Forster et al. | |
| 2014/0345654 | A1 | 11/2014 | Cho et al. | |
| 2016/0015241 | A1 | 1/2016 | Han et al. | |
| 2016/0192818 | A1 | 7/2016 | Gursoy et al. | |

FOREIGN PATENT DOCUMENTS

| | | | |
|---|---|---|---|
| CN | 104271024 | A | 1/2015 |
| CN | 1040284620 | A | 1/2015 |
| CN | 102905602 | A | 1/2016 |
| DE | 8516941 | U1 | 11/1986 |
| DE | 20014038 | U1 | 1/2001 |
| DE | 29921565 | U1 | 5/2001 |
| DE | 19736919 | B4 | 8/2007 |
| DE | 10 2011088494 | A1 | 6/2013 |
| EP | 1 238 622 | B1 | 2/2010 |
| EP | 2 192 852 | B1 | 6/2010 |
| EP | 2 240 065 | A1 | 10/2010 |
| EP | 2 389 851 | A1 | 11/2011 |
| EP | 2 389 852 | A1 | 11/2011 |
| EP | 2 441 369 | A2 | 4/2012 |
| EP | 2 446 799 | A2 | 5/2012 |
| EP | 2 494 906 | A1 | 9/2012 |
| EP | 1 767 134 | B1 | 11/2014 |
| EP | 2 067 428 | B1 | 11/2014 |
| EP | 3 085 293 | A1 | 10/2016 |
| IT | TO 20030117 | | 1/2005 |
| JP | H04338438 | A | 11/1992 |
| JP | H07163505 | A | 6/1995 |
| JP | H07250799 | A | 10/1995 |
| JP | H10127560 | A | 5/1998 |
| JP | 2861792 | B2 | 2/1999 |
| JP | 2011224232 | A | 11/2011 |
| KR | 102012022429 | A | 3/2012 |
| KR | 102012078276 | A | 7/2012 |
| WO | WO 2006/069827 | A1 | 7/2006 |
| WO | WO 2009/021626 | A1 | 2/2009 |
| WO | WO 2009/083576 | A1 | 7/2009 |
| WO | WO 2010/038189 | A1 | 4/2010 |
| WO | WO 2011/147716 | A1 | 12/2011 |
| WO | WO 2015/149859 | A1 | 10/2015 |

OTHER PUBLICATIONS

Office Action for Brazilian Application No. BR 112018011079-5 dated Mar. 5, 2020, 4 pages.

1st Office Action for China Application No. 2015800854175-5 dated Aug. 12, 2020 (8 pages).

Chinese Office Action for Chinese Application No. 201580085417.5, dated Mar. 3, 2021 with translation, 13 pages.

* cited by examiner

DISHWASHER COMPRISING A WASH ARM ARRANGEMENT

CROSS-REFERENCE TO RELATED APPLICATIONS

This application is a national stage application filed under 35 U.S.C. § 371 of International Application No. PCT/EP2015/080746 filed Dec. 21, 2015, which application is hereby incorporated by reference in its entirety.

TECHNICAL FIELD

The present disclosure relates to a dishwasher comprising a wash arm arrangement.

BACKGROUND

Today's dishwashers are expected to perform high quality wash of dishware, and environmental concerns require an efficient use of energy and water during operation. A dishwasher usually comprises a washing chamber in which an upper rack and a lower rack for accommodating items to be washed are arranged. In some modern dishwashers it is possible to adjust the upper rack in height to adapt the rack to different sizes of dishes. Further, a dishwasher usually comprises an upper wash arm and a lower wash arm. The upper wash arm may be attached to the upper rack or to an interior wall of the washing chamber and the lower arm may be arranged above a sink at a bottom part of the washing chamber.

One problem is to configure a dishwasher with a wash arm capable of thoroughly rinsing any dishware arranged at a rack and also all necessary parts and locations within the washing chamber. Another problem is to achieve a less complex dishwasher with maintained or increased functionality. A further problem is to configure a wash arm to perform proper washing of the dishes and to enable a proper rinse at all the desired locations in the dishwasher independently of rack and/or wash arm position.

SUMMARY

An object of embodiments herein is to provide a dishwasher capable of efficient rinsing of all necessary parts and locations within the washing chamber.

According to an aspect of the invention, the object is achieved by a dishwasher having a washing chamber and a door comprising a detergent dispenser, the dishwasher comprising a wash arm arrangement with a rotatable first wash arm arranged within the washing chamber, wherein the wash arm arrangement comprises a second wash arm which is rotatably attached to the rotatable first wash arm, the second wash arm comprising a spray nozzle arranged to expel washing liquid in a direction relatively the second wash arm, wherein the second wash arm is arranged to bring the spray nozzle along a circular path with a radius in a plane during a rotation cycle of the second wash arm, wherein the direction has a first angle in the plane relatively the radius and a second angle relatively the plane, and wherein the spray nozzle is arranged to be directed in the direction towards the detergent dispenser during at least a portion of the rotation cycle to cause the washing liquid to intersect with the detergent dispenser.

Since the wash arm arrangement comprises the second wash arm which is rotatably attached to the rotatable first wash arm the entire second wash arm will be rotated via the rotatable first wash arm during operation of the dishwasher. The rotatable first wash arm can also be referred to as first wash arm. The spray nozzle of the second wash arm will also cause the second wash arm to rotate around a centre axis of the second wash arm. Hereby expelled washing liquid will be efficiently distributed over any dishware arranged on racks within the washing chamber.

Since the spray nozzle is arranged to be directed in the direction towards the detergent dispenser during at least a portion of the rotation cycle to cause the washing liquid to intersect with the detergent dispenser it can also be referred to as detergent dispenser nozzle. A beam of washing liquid expelled through the spray nozzle will directly hit the detergent dispenser during at least a portion of the rotation cycle.

The spray nozzle is directed with the first angle relatively the radius and the second angle relatively the plane. The first angle and the second angle are selected such that the washing liquid expelled through the spray nozzle intersects with the detergent dispenser during at least a portion of the rotation cycle. In other words, a beam of washing liquid expelled through the spray nozzle will directly hit the detergent dispenser during at least a portion of the rotation cycle. Hereby the detergent dispenser will be rinsed more efficiently than if only rinsed by any washing liquid scattered within the washing chamber as a function of rotating wash arms. It is hereby ensured that no residual washing powder or liquid detergent is left in the detergent dispenser. Accordingly, efficient rinsing within the detergent dispenser is achieved by a sole spray nozzle. As a result, the above mentioned object is achieved.

Optionally, the second angle is in the range of 1-60 degrees. Thereby, the washing liquid will be expelled by the spray nozzle towards the detergent dispenser at the second angle in the range of 1-60 degrees. Since the washing liquid will be expelled at the second angle in the range of 1-60 degrees the distance for the washing liquid to travel from the nozzle to the door of the dishwasher will be greater as compared to a distance between the spray nozzle and the door if the second angle is 0 degree and if the washing liquid is expelled by the spray nozzle in the rotation plane of the spray nozzle. Hereby an intersection path between the door and a beam of washing liquid on a surface of the door which faces the washing chamber will have a relatively long vertical extension. With a relatively long vertical extension of the intersection path the washing liquid can be controlled to intersect with, or hit, the detergent dispenser independently of a relative height between the second wash arm and the detergent dispenser. The length of the vertical extension of the intersection path depends e.g. on the second angle. A larger second angle provides for a longer vertical extension of the intersection path. The length of the vertical extension may alternatively be referred to as a height or magnitude of the vertical extension.

Optionally, the second angle is directed downwards relatively the plane. Thereby, the detergent dispenser can be efficiently rinsed when arranged lower than the plane.

Optionally, the second angle is directed upwards relatively the plane. Thereby, the detergent dispenser can be efficiently rinsed when arranged at a position above the plane.

Thus, the second wash arm can be arranged to efficiently rinse detergent dispensers independently of a relative height between the second wash arm and the detergent dispenser.

Optionally, the first angle is in the range of 45-89 degrees. Thereby, the washing liquid will be expelled by the spray nozzle towards the detergent dispenser at the first angle in the range of 45-89 degrees. In some embodiments the first angle is sharp. Thus, the washing liquid will be expelled by the spray nozzle in a direction inwards relatively the circular path. Since the washing liquid will be expelled inwards relatively the circular path the spray nozzle may be arranged such that the second angle will be relatively small. Thereby the washing liquid expelled towards the detergent dispenser will hit the detergent dispenser with a less acute angle relatively a main extension of the detergent dispenser. Thus, an efficient rinsing of the detergent dispenser is achieved. Since the washing liquid will be expelled inwards relatively the circular path also an even rinse of dishes arranged within the washing chamber will be achieved.

Optionally, the first angle is in the range of 91-135 degrees. Thereby, the washing liquid will be expelled by the spray nozzle towards the detergent dispenser at the first angle in the range of 91-135 degrees. Thus, the washing liquid will be expelled by the spray nozzle in a direction outwards relatively the circular path. Since the washing liquid will be expelled by the spray nozzle in the direction outwards the circular path, the spray nozzle can be arranged such that the second angle will be relatively large. Thereby, the washing liquid will also be effectively expelled towards dishes arranged within the washing chamber during portions of some of the rotation cycles. Thus, more effective washing of dishes arranged within the washing chamber is achieved.

Optionally, the wash arm arrangement is an upper wash arm arrangement, arranged to be mounted above any lower wash arm arrangement within the washing chamber. Hereby the wash arm arrangement can be positioned such that the washing liquid from the spray nozzle efficiently can reach the detergent dispenser when the detergent dispenser is positioned at a middle- or upper portion of the door.

Optionally, the wash arm arrangement is arranged to be displaceable between a first position and a second position, the first position and the second position being different height positions within the washing chamber. A sole spray nozzle according to embodiments herein is capable to efficiently rinse the detergent dispenser independently of whether the wash arm arrangement is positioned within the first or second position, i.e. independently of the relative height between the second wash arm and the detergent dispenser.

Optionally, the rotatable first wash arm is arranged to rotate at a first velocity and the second wash arm is arranged to rotate at a second velocity, the first velocity being different from the second velocity. Hereby the first wash arm and the second wash arm will have different mutual positions for different rotational cycles of the second wash arm whereby even and efficient rinsing of the dishwasher is achieved.

BRIEF DESCRIPTION OF THE DRAWINGS

The various aspects of the invention, including its particular features and advantages, will be readily understood from the following detailed description and the accompanying drawings, in which.

DETAILED DESCRIPTION

The embodiments herein will now be described more fully with reference to the accompanying drawings. Like numbers refer to like elements throughout.

Figure 1:
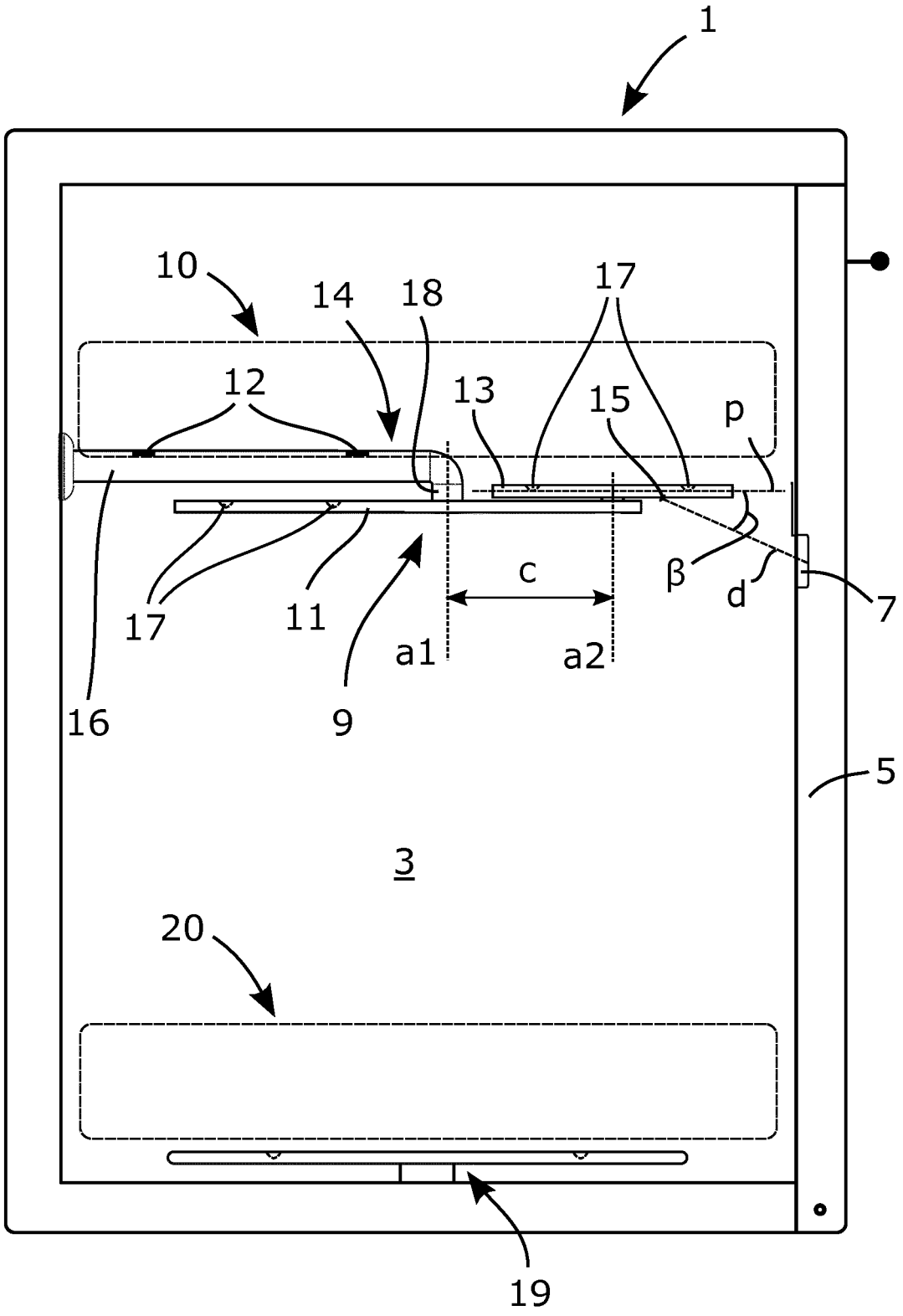
FIG. 1 illustrates a dishwasher and a wash arm arrangement according to some embodiments.

FIG. 1 illustrates a dishwasher 1 having a washing chamber 3 and a door 5 comprising a detergent dispenser 7. As illustrated in FIG. 1, the dishwasher 1 comprises a wash arm arrangement 9 with a rotatable first wash arm 11 arranged to rotate around a first rotation axis a1 within the washing chamber 3. The rotatable first wash arm 11 can also be referred to as first wash arm.

According to the embodiment illustrated in FIG. 1, the dishwasher 1 comprises a rack 10 arranged to accommodate items (not shown) to be washed in the dishwasher 1. The wash arm arrangement 9 may be fastened to the rack 10 by attachment means 12. A position change of the rack 10, e.g. between an upper and a lower position, will result in a position change of the wash arm arrangement 9.

The wash arm arrangement 9 comprises a second wash arm 13 which is rotatably attached to the first wash arm 11 and is arranged to rotate around a second rotation axis a2. Thus, the entire second wash 13 arm will be rotated via the first wash arm 11 during operation of the dishwasher 1. Further, because the second wash arm 13 is rotatably attached to the first wash arm 11, the second wash arm 13 may rotate around the second rotation axis a2 while the first wash arm 11 rotates around the first rotation axis a1.

The first rotation axis a1 and the second rotation axis a2 are arranged at a distance c from each other. The distance c and a length of the second wash arm 13 are selected such that the second arm 13 is allowed to rotate in an unobstructed manner around the second rotation axis a2.

A washing liquid pipe 14 may be arranged to feed washing liquid to the wash arm arrangement 9. The washing liquid pipe 14 may be arranged with a first end 16 arranged towards a washing liquid supply or connection (not shown) and a second end 18 arranged as an attachment portion for the first wash arm 11. The washing liquid pipe 14, the first wash arm 11 and the second wash arm 13 may be arranged as hollow bodies.

The first wash arm 11 and the second wash arm 13 may comprise a number of nozzles 17 arranged to expel washing liquid towards the items at the rack 10 to wash and/or rinse the items. The first wash arm 11 and/or the second wash arm 13 may comprise further nozzles (not shown), which are arranged to expel washing liquid such that rotation of the first and/or second wash arm(s) 11, 13 are achieved. In some embodiments, rotation of the first and/or second wash arm(s) 11, 13 are provided by means of an electric motor (not shown).

The second wash arm 13 also comprises a spray nozzle 15 arranged to expel washing liquid into the washing chamber 3. The spray nozzle 15 can also be referred to as dedicated detergent dispenser nozzle which is arranged to rinse the detergent dispenser 7 during operation of the dishwasher 1. The spray nozzle 15 has both the function of rinsing the detergent dispenser 7 and to cause the second wash arm 13 to be rotated. The spray nozzle 15 is arranged to be directed towards the detergent dispenser 7 in a direction d having a first angle $\alpha$, described below, and a second angle $\beta$ relatively a rotation plane p of the second wash arm 13. The spray nozzle 15 is directed towards the detergent dispenser 7 in the direction d during at least a portion of a rotation cycle of the second wash arm 13 and during at least a portion of some of rotational cycles of the first spray arm 11. The portions of the rotational cycles of the first wash arm 11 and the second wash arm 13 may, for example relate to a time range or to a part of the rotational cycles.

As illustrated in FIG. 1, angle β is sharp relatively the plane p in the FIG. 1 embodiment. Thus, the angle β is an angle between the direction d and the plane p in a vertical plane extending through the direction d and an orthogonal projection of the direction d on the plane p. When the nozzle 15 is directed towards the detergent dispenser 7, as illustrated in FIG. 1, the angle β is thus the angle between the direction d and the plane p. The angle β may have substantially the same magnitude during rotation of the second wash arm 13. When the second wash arm 13 is rotated the spray nozzle 15 will be brought along a circular path, further illustrated in conjunction with FIGS. 3 and 4.

As illustrated in FIG. 1, the spray nozzle 15 is arranged to be directed towards the detergent dispenser 7, thereby causing the washing liquid to intersect with, or hit, the detergent dispenser 7.

The angle β is chosen such that a beam of washing liquid ejected by the spray nozzle 15 in the direction d hits the detergent dispenser 7 during at least a portion of the rotational cycles of the first wash arm 11 and the second wash arm 13. Thus, a major portion or a core portion of the beam ejected by the spray nozzle 15 is controlled to enter interior surfaces of the detergent dispenser 7 while the beam passes the detergent dispenser 7 during at least a portion of the rotation cycles of the first wash arm 11 and the second wash arm 13. Thereby, the spray nozzle 15 is dedicated to expel washing liquid towards the detergent dispenser 7 in contrast to the nozzles 17 which mainly direct the washing liquid towards items accommodated at the rack 10 in order to wash and/or rinse the items. Hereby the detergent dispenser 7 will be rinsed more efficiently than if only rinsed by any washing liquid scattered within the washing chamber of the dishwasher 1. It is hereby ensured that no residual washing powder or liquid detergent is left in the detergent dispenser 7. Accordingly, both efficient rinsing, and avoidance of clogging within the detergent dispenser 7 is achieved by a sole spray nozzle 15. The spray nozzle 15 is arranged to be directed towards the detergent dispenser 7 during at least a portion of the rotation cycles of the first wash arm 11 and the second wash arm 13 to cause the washing liquid to intersect with the detergent dispenser 7. Thus, the spray nozzle 15 is arranged to be directed towards the detergent dispenser 7 for at least a predetermined amount of time of at least a predetermined subset of rotation cycles of a dishwasher washing program or similar. When not directed towards the detergent dispenser 7, the spray nozzle 15 may be configured to wash and/or rinse other parts within the dishwasher chamber 3.

According to the embodiment illustrated in FIG. 1 the detergent dispenser 7 is positioned downwards relatively the plane p. It is understood that "downwards" here relates to a direction when the dishwasher 1 is arranged in a normal operating position where a lower portion with a sink or similar is arranged downwards. Upwards is thus the opposite direction, facing towards an upper portion of the dishwasher 1. Therefore, the spray nozzle 15 is directed downwards in the second angle β relatively the plane p. The second angle β may be in the range of 1-60 degrees. The second angle β is selected such that the washing liquid hits the detergent dispenser 7 when expelled through the spray nozzle 15.

As illustrated in FIG. 1, the dishwasher 1 may comprise a second rack 20 adapted to accommodate items (not shown) to be washed in the dishwasher 1 and a lower wash arm arrangement 19. Thus, the wash arm arrangement 9 in FIG. 1 is an upper wash arm arrangement, arranged to be mounted above the lower wash arm arrangement 19. The rack 10 may be referred to as an upper rack and the second rack 20 may be referred to as a lower rack. Thus, the spray nozzle 15 is arranged to, when not directed towards the detergent dispenser 7, wash and/or rinse other parts within the dishwasher chamber 3, such as items (not shown) on the rack 20.

Figure 2:
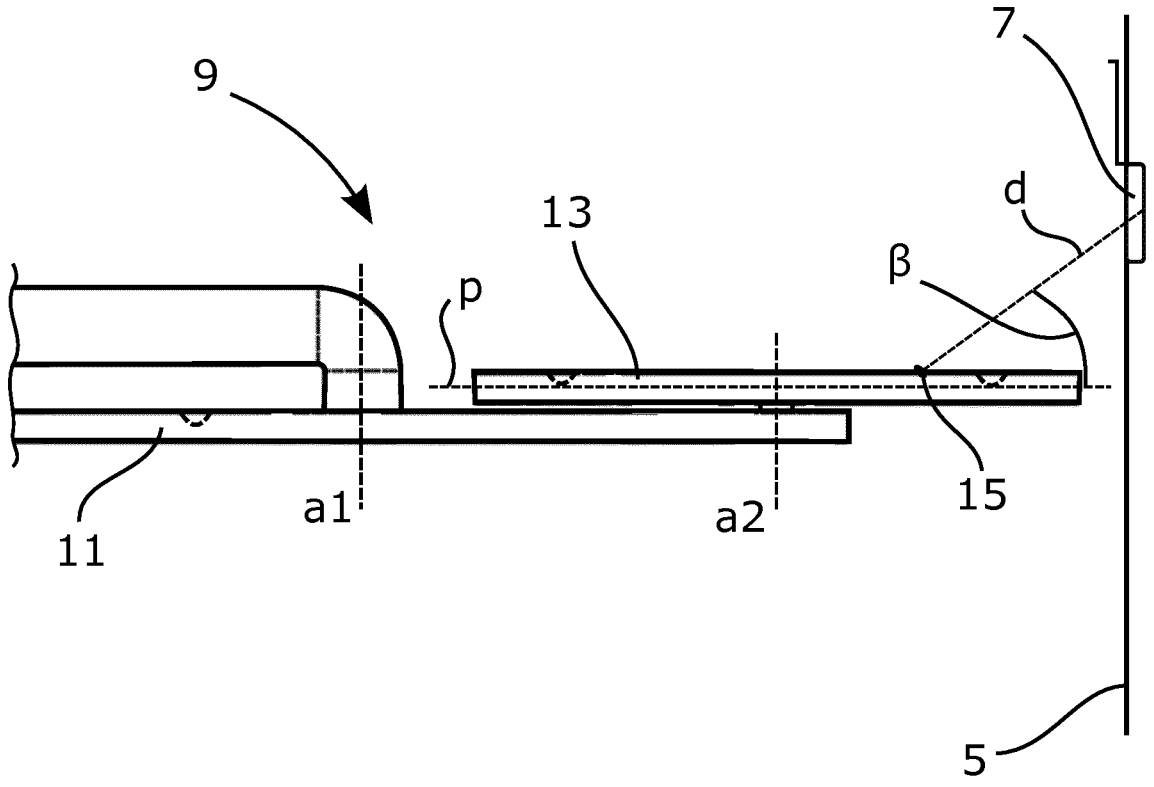
FIG. 2 illustrates a wash arm arrangement according to some other embodiments.

FIG. 2 illustrates the wash arm arrangement 9 according to an alternative embodiment. As described in conjunction with FIG. 1, the wash arm arrangement 9 comprises the first wash arm 11 and the second wash arm 13. The second wash arm 13 comprises the spray nozzle 15 which is arranged to expel washing liquid into the washing chamber 3. According to the embodiment illustrated in FIG. 2, the spray nozzle 15 is arranged to be directed towards the detergent dispenser 7 in a direction d having a second angle β relatively the plane p, wherein the second angle β is directed upwards relatively the plane p. Thereby, the detergent dispenser 7 can also be efficiently rinsed when it is arranged at a position above the plane p. As illustrated in FIG. 2, angle β is sharp relatively the plane p in some embodiments herein.

The wash arm arrangement 9 may be arranged as a middle or an upper wash arm arrangement within the washing chamber of the dishwasher. The spray nozzle 15 is arranged to be directed towards the detergent dispenser 7 during at least a portion of the rotation cycles of the first wash arm 11 and the second wash arm 13 to cause the washing liquid to intersect with the detergent dispenser 7. Thus, the spray nozzle 15 is arranged to be directed towards the detergent dispenser 7 for at least a predetermined amount of time of at least a predetermined subset of rotation cycles of a dishwasher washing program or similar. The spray nozzle 15 is arranged to, when not directed towards the detergent dispenser 7, to wash and/or rinse other parts within the dishwasher chamber 3, such as items on a rack arranged above the wash arm arrangement 9. Similarly to the embodiment illustrated in FIG. 1, with the second angle β directed downwards, the second angle β, according to the embodiment in FIG. 2, may be in the range of 1-60 degrees. The second angle β is selected such that the washing liquid hits the detergent dispenser 7 when expelled through the spray nozzle 15.

Figure 3:
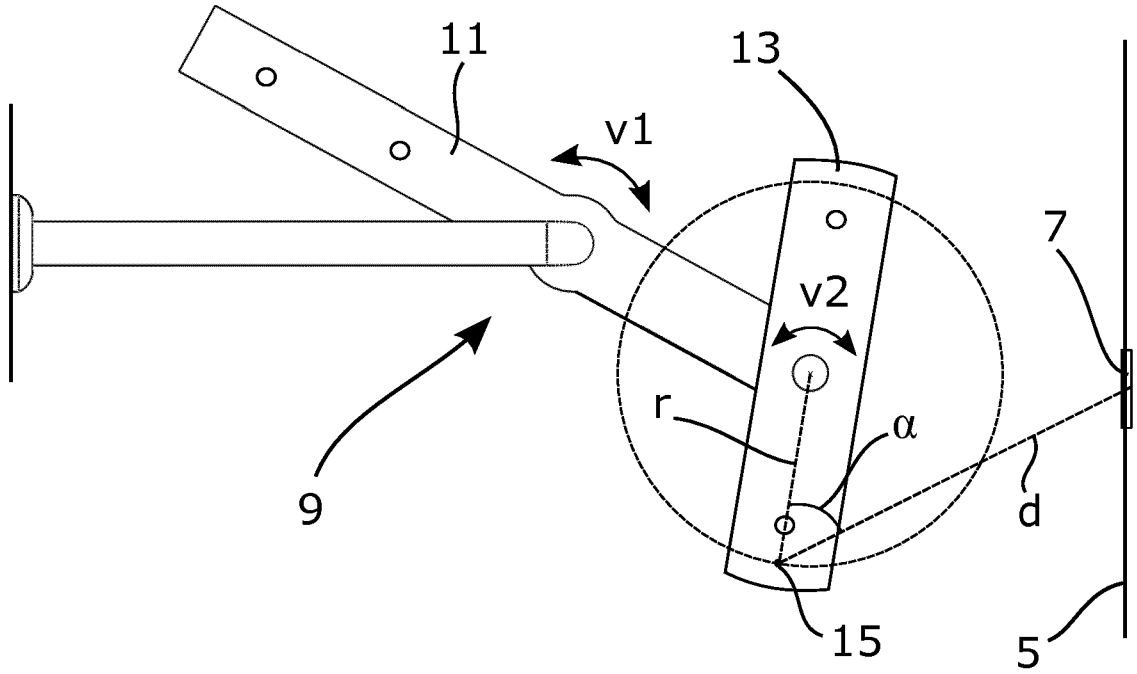
FIG. 3 illustrates a wash arm arrangement according to some alternative embodiments as seen from above.

FIG. 3 illustrates the wash arm arrangement 9, the rotatable first wash arm 11, the second wash arm 13 and the spray nozzle 15 from above. The second wash arm 13 is arranged to bring the spray nozzle 15 along a circular path with a radius r. The circular path is illustrated with dashed lines in FIG. 3. When both the first wash arm 11 and the second wash arm 13 are rotated the entire circular path will be rotated around the rotation axis of the first wash arm 11. The spray nozzle 15 is arranged to rotate in the plane denominated pin FIG. 1 during rotation cycles of the second wash arm 13. The spray nozzle 15 is arranged to be directed towards the detergent dispenser 7 in a direction d having a first angle α relatively the radius r and arranged to cause the washing liquid to intersect with, or hit, the detergent dispenser 7 during at least a portion of some of the rotation cycles. According to the embodiment illustrated in FIG. 3 the first angle α is in the range of 0-89 degrees, however the first angle α may also be in the range of 45-89 degrees. In the embodiment depicted in FIG. 3 the first angle α is thus sharp. In other words, the washing liquid will be expelled by the spray nozzle 15 in the direction d inwards relatively the circular path.

Figure 4:
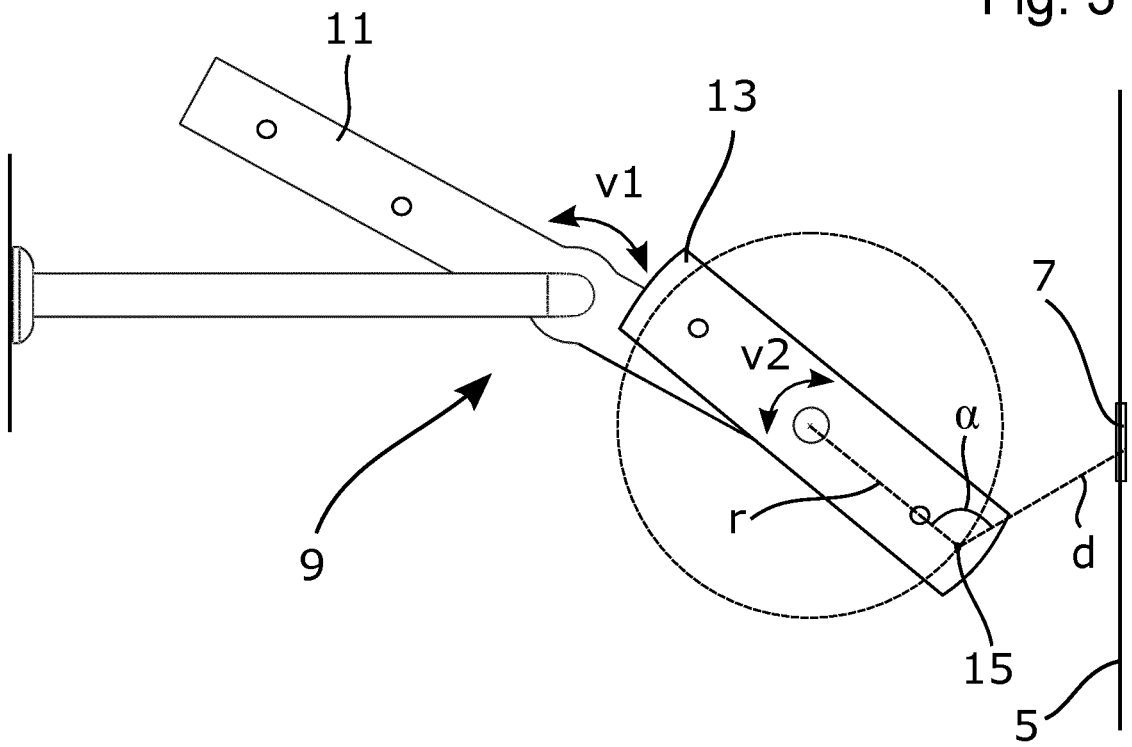
FIG. 4 illustrates a wash arm arrangement according to yet some alternative embodiments as seen from above.

The embodiment illustrated in FIG. 4 resembles the embodiment illustrated in FIG. 3 but in this embodiment the first angle α is blunt. The first angle α may be in the range of 91-135 degrees. In other words, the washing liquid will be expelled by the spray nozzle 15 in a direction d outwards relatively the circular path.

In the embodiments illustrated in FIG. 3 and FIG. 4 the rotatable first wash arm 11 is arranged to rotate at a first velocity v1 and the second wash arm 13 is arranged to rotate at a second velocity v2. Since the first velocity v1 may be different from the second velocity v2, the first wash arm 11 and the second wash arm 13 will have different mutual positions for different rotational cycles of the second wash arm 13.

According to some embodiments the wash arm arrangement 9 may be arranged to be displaceable between a first position and a second position where the first position and the second position being different height positions within the washing chamber 3. The wash arm arrangement 9 may be arranged to be attached to an upper rack, denominated 10 in FIG. 1. The wash arm arrangement 9 may thereby be positioned in an upper position when the rack 10 is positioned in an upper position and in a lower position when the rack 10 is positioned in a lower position. The lower positions and the upper positions here refer to different height positions of the same rack and wash arm arrangement. Thereby, user may displace the wash arm arrangement 9 and the upper rack 10 to adapt the dishwasher to items to be washed and to be accommodated at the rack 10 and at a rack denominated 20 in FIG. 1. Spray paths/patterns for different height positions, i.e. the upper position and the lower position are further discussed in conjunction with FIG. 5.

Figure 5:
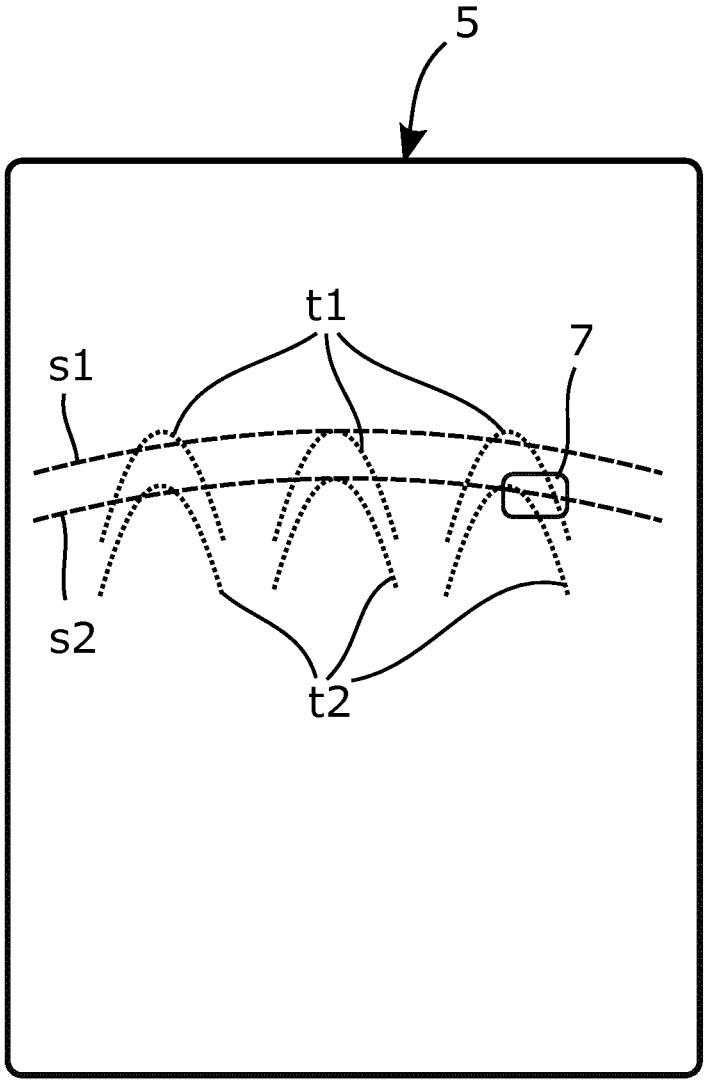
FIG. 5 illustrates a door of the FIG. 1 dishwasher according to some embodiments and paths from washing liquid beams sprayed on the door.

FIG. 5 illustrates paths s1 and s2. Paths s1 and s2 represent a pattern that beams of washing liquid ejected from a nozzle at a traditional wash arm will cause on a door 5 of a dishwasher. The path s1 is achieved when the traditional wash arm is arranged in an upper position and the path s2 is achieved when the traditional wash arm is arranged in a lower opposition. As depicted in FIG. 5 only one of the paths s1 and s2 with relative long horizontal extension and relatively short vertical extension for each of the upper and lower positions are achieved. Only the beam of washing liquid at the lower position, along the path s2 of the traditional wash arm, hits the detergent dispensed 7. When the traditional wash arm is positioned in the upper position the path s1 does not intersect with or hit the detergent dispenser 7. Hereby the detergent dispenser 7 will only be rinsed by any "ambient" washing liquid scattered around in the washing chamber.

Paths t1 and t2 illustrate patterns caused by a spray nozzle according to embodiments herein. As illustrated in FIG. 5 a larger amount of paths are achieved as compared to the paths s1 and s2 achieved by a traditional wash arm. Thereby, noise caused when the beams of washing liquid traveling along paths t1 and t2 hit the door 5 by will have a pulsating character. Noise caused when the beams of washing liquid traveling along paths s1 and s2 on the door 5 will have a continuous character. The pulsating character of the noise may be preferable as it more clearly indicates that the dishwasher is in use and may be less perceived as background noise.

In some embodiment the wash arm arrangement is arranged to be displaceable between a first position and a second position, the first position and the second position being different height positions within the washing chamber.

The path t1 is achieved at the first, here upper, position and the path t2 is achieved at the second, here lower, position of the wash arm arrangement. The paths t1 and t2 have a reverse U-form having a horizontal extension and a vertical extension. The number of paths t1 and t2 on the door 5 is a function that depends on a ratio between the first velocity and the second velocity of the first wash arm and the second wash arm respectively. The horizontal extension of path t1 and t2 can be controlled e.g. by adjustment of the first velocity, the second velocity or the ratio between the first velocity and the second velocity. The horizontal extension of path t1 and t2 can be adjusted such that at least one of paths t1 and t2 hits the detergent dispenser 7 on the door 5.

Also the vertical extension of the paths t1 and t2 are a function of the first velocity and the second velocity of the first wash arm and the second wash arm respectively. Further, the horizontal extension and the vertical extension of the paths t1 and t2 are a function of the first angle α and the second angle β. Both the horizontal extension and the vertical extension of the paths t1 and t2 may be controlled by adjustment of the first velocity and the second velocity of the first wash arm and the second wash arm. Further the horizontal extension and the vertical extension of the paths t1 and t2 may also be controlled by selection of the first angle and the second angle based on the position of the detergent dispenser for a particular type of dishwasher.

The vertical extension of the paths t1 and t2 depends to a large extent on the second angle β. A relatively large second angle β provides for a relatively long vertical extension of the paths t1 and t2.

As illustrated in FIG. 5, the detergent dispenser 7 is hit by a beam of washing liquid ejected from the spray nozzle both when the wash arm arrangement is in the first, upper position, illustrated by the path t1 and in the second, lower, position, illustrated by the path t2. Therefore a sole spray nozzle according to embodiments herein is capable to efficiently rinse the detergent dispenser 7 independently of whether the wash arm arrangement is positioned within the first or second position, i.e. independently of the relative height between the second wash arm and the detergent dispenser.

Paths t1 and t2 can also be referred to as intersection paths. The reverse U-shape is at least partly caused by the fact that the spray nozzle expels the washing liquid upwards or downwards relatively the rotation plane of the second spray arm. Expelled washing liquid will not hit the door substantially perpendicularly, but is instead controlled to travel in a bow-shape. The vertical extension of paths t1 and t2 are therefore larger than a vertical extension of paths s1 and s2. In some embodiments the vertical extension on a path, or intersection path, is controlled to have a predetermined minimum extension.

The invention claimed is:

1. A dishwasher comprising:

a washing chamber;

a door comprising a detergent dispenser; and a wash arm arrangement comprising:

a rotatable first wash arm arranged within said washing chamber, and a second wash arm which rotatably attached to said rotatable first wash arm, said second wash arm comprising a spray nozzle arranged to expel washing liquid in a direction relative to said second wash arm, wherein said second wash arm is arranged to bring said spray nozzle along a circular path with a radius in a plane defined by said second wash arm during a rotation cycle of said second wash arm, wherein said direction has a first angle in said plane relative to said radius and a second angle relative to said plane, and wherein said spray nozzle is configured to be directed in said direction towards said detergent dispenser during at least a portion of said rotation cycle to cause said washing liquid to intersect with said detergent dispenser.

2. The dishwasher according to claim 1, wherein said second angle is in the range of 1-60 degrees.

3. The dishwasher according to claim 1, wherein said second angle is directed downwards relative to said plane.

4. The dishwasher according to claim 1, wherein said second angle is directed upwards relative to said plane.

5. The dishwasher according to claim 1, wherein said first angle is in the range of 45-89 degrees.

6. The dishwasher according to claim 1, wherein said first angle is in the range of 91-135 degrees.

7. The dishwasher according to claim 1, wherein said wash arm arrangement is an upper wash arm arrangement, arranged to be mounted above any lower wash arm arrangement within the washing chamber.

8. The dishwasher according to claim 1, wherein said rotatable first wash arm is arranged to rotate at a first velocity and said second wash arm is arranged to rotate at a second velocity, wherein said first velocity is different from said second velocity.

9. The dishwasher according to claim 1, wherein said second wash arm is configured such that washing liquid expelled from said spray nozzle traces a reverse U-path on said door.

10. The dishwasher according to claim 1, wherein said wash arm arrangement is arranged to be displaceable between a first position and a second position, wherein said first position and said second position are different height positions within said washing chamber.

11. The dishwasher according to claim 10, wherein said spray nozzle is arranged to be directed in said direction towards said detergent dispenser during at least a portion of said rotation cycle to cause said washing liquid to intersect with said detergent dispenser when said wash arm arrangement is in the first position and when said wash arm arrangement is at the second position.

12. The dishwasher according to claim 10, wherein said second wash arm is configured such that washing liquid expelled from said spray nozzle traces a reverse U-path on said door, the reverse U-path intersecting with said detergent dispenser when said wash arm arrangement is in the first position and when said wash warm arrangement is in the second position.

* * * * *